US011287769B2

(12) United States Patent
Tanaka et al.

(10) Patent No.: US 11,287,769 B2
(45) Date of Patent: Mar. 29, 2022

(54) IMAGE FORMING APPARATUS CONFIGURED TO DETERMINE AN AMOUNT OF WASTE TONER

(71) Applicant: BROTHER KOGYO KABUSHIKI KAISHA, Nagoya (JP)

(72) Inventors: Nobuyuki Tanaka, Konan (JP); Toshio Furukawa, Aichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/157,401

(22) Filed: Jan. 25, 2021

(65) Prior Publication Data

US 2021/0232081 A1 Jul. 29, 2021

(30) Foreign Application Priority Data

Jan. 27, 2020 (JP) ..... JP2020-010906

(51) Int. Cl.
*G03G 21/12* (2006.01)
*G03G 21/10* (2006.01)

(52) U.S. Cl.
CPC ..... *G03G 21/12* (2013.01); *G03G 21/105* (2013.01); *G03G 2221/1627* (2013.01)

(58) Field of Classification Search
CPC ..... G03G 21/12; G03G 21/105; G03G 2221/1627
See application file for complete search history.

(56) References Cited

U.S. PATENT DOCUMENTS 4,711,561 A * 12/1987 Tsuruoka ..... G03G 21/12 399/35
4,868,599 A * 9/1989 Niki ..... G03G 21/12 399/35
4,982,230 A * 1/1991 Ogura ..... G03G 21/12 399/348
5,260,755 A * 11/1993 Imaizumi ..... G03G 21/12 399/35
5,400,127 A * 3/1995 Arai ..... G03G 21/12 399/358
5,500,716 A * 3/1996 Morishita ..... G03G 15/553 399/35

(Continued)

FOREIGN PATENT DOCUMENTS

JP 2014-89422 A 5/2014

*Primary Examiner* — Walter L Lindsay, Jr.
*Assistant Examiner* — Milton Gonzalez
(74) *Attorney, Agent, or Firm* — Merchant & Gould P.C.

(57) ABSTRACT

An image forming apparatus comprises, a collecting member configured to collect waste toner adhered on a conveying belt, a cleaning voltage supplier configured to supply a cleaning voltage to the collecting member, a container having a first contact and configured to contain the collected waste toner, and an attachment part having a second contact configured to contact the first contact. The container is detachably attached to the attachment part. The image forming part further comprises a switch configured such that a switching state is switchable based on an amount of the waste toner in the container. The image forming apparatus generates a detection signal based on a voltage at the second contact to determine whether an amount of the waste toner in the container is greater than a particular amount.

8 Claims, 9 Drawing Sheets

(56) References Cited

U.S. PATENT DOCUMENTS

| | | | | |
|---|---|---|---|---|
| 7,403,738 | B2 * | 7/2008 | Murakami | G03G 21/12 399/360 |
| 7,764,889 | B2 * | 7/2010 | Hamaya | G03G 15/166 399/44 |
| 7,809,293 | B2 * | 10/2010 | Inukai | G03G 21/1652 399/37 |
| 7,933,525 | B2 * | 4/2011 | Naganawa | G03G 15/168 399/12 |
| 8,600,246 | B2 * | 12/2013 | Kurimoto | G03G 21/12 399/35 |
| 8,792,798 | B2 * | 7/2014 | Inukai | G03G 15/161 399/71 |
| 9,207,613 | B2 * | 12/2015 | Hamaya | G03G 15/553 |

* cited by examiner

IMAGE FORMING APPARATUS CONFIGURED TO DETERMINE AN AMOUNT OF WASTE TONER

CROSS-REFERENCE TO RELATED APPLICATIONS

This application claims priority under 35 U.S.C. § 119 from Japanese Patent Application No. 2020-010906 filed on Jan. 27, 2020. The entire subject matter of the application is incorporated herein by reference.

BACKGROUND

Technical Field

The present disclosures relate to an image forming apparatus configured to form an image using a developing agent such as toner. More particularly, the present disclosures relate to a technique of detecting, in such an image forming apparatus, that a container collecting adhered substances (e.g., waste toner) such as developing agent and paper powders is full of such adhered substances.

Related Art

There has been known an image forming apparatus provided with a waste toner box accommodating waste toner to be discarded, and a full state detection switch configured to detect that the waste toner box is full of the waste toner. According to one conventional configuration, one end of the full state detection switch is connected to an electrode provided to a sidewall of the waste toner box, while the other end of the full state detection switch is connected to another electrode, which is also provided to the sidewall of the waste toner box. The two electrodes are attached to an outer peripheral wall of the waste toner box. When a belt cleaner is attached to an attachment position of a body frame, the two electrodes provided to the waste toner box respectively contact the electrodes provided to the body frame. In this state, by detecting a voltage between the two electrodes provided to the body frame, whether the waste toner box is full of waste toner can be detected.

SUMMARY

According to the above-described conventional art, a substrate on which the electrodes are formed is plated. When the image forming apparatus form an image, the image forming apparatus vibrates. When the image forming apparatus vibrates, contacting portions between the contacting electrodes rub against each other, and the plates at the contacting portions may be removed. When the plates of the electrodes are removed, the voltage at the electrodes increases due to an increase of contact resistance between the electrodes. Then, the waste toner box may falsely be detected as full even though the waste toner box is not full.

According to aspects of the present disclosure, there is provided an image forming apparatus, including a transferring part having a belt, the transferring part configured to transfer a toner image formed on a photosensitive member onto the sheet, a collecting member configured to collect waste toner from the belt, a collecting voltage supplier configured to supply a collecting voltage causing the collecting member to generate attracting voltage to collect the waste toner from the belt, a container having a first contact and configured to contain the waste toner collected by the collecting member, an attachment part having a second contact configured to contact the first contact, the attachment part being configured such that the container is detachably attached to the attachment part, a switch configured such that a switching state is switchable between a closed state and an opened state, a first end of the switch being connected to the first contact, the switching state being changed from the closed state to the opened state when an amount of the waste toner in the container is greater than a particular amount, an attracting voltage supplying circuit configured to supply the attracting voltage to a second end from the collecting member, the second end being an opposite end to the first end of the switch, a detection signal generator connected to the second contact and is configured to generate a detection signal based on a voltage at the second contact, and a determination part configured to determine whether or not an amount of the adhered substances in the container is greater than the particular amount based on the detection signal.

DETAILED DESCRIPTION OF THE EMBODIMENTS

First Embodiment

Initially, a laser printer according to a first embodiment of the present disclosures will be described. It is noted that the laser printer is an example of an image forming apparatus according to the present disclosures.

General Configuration of Laser Printer

Figure 1:
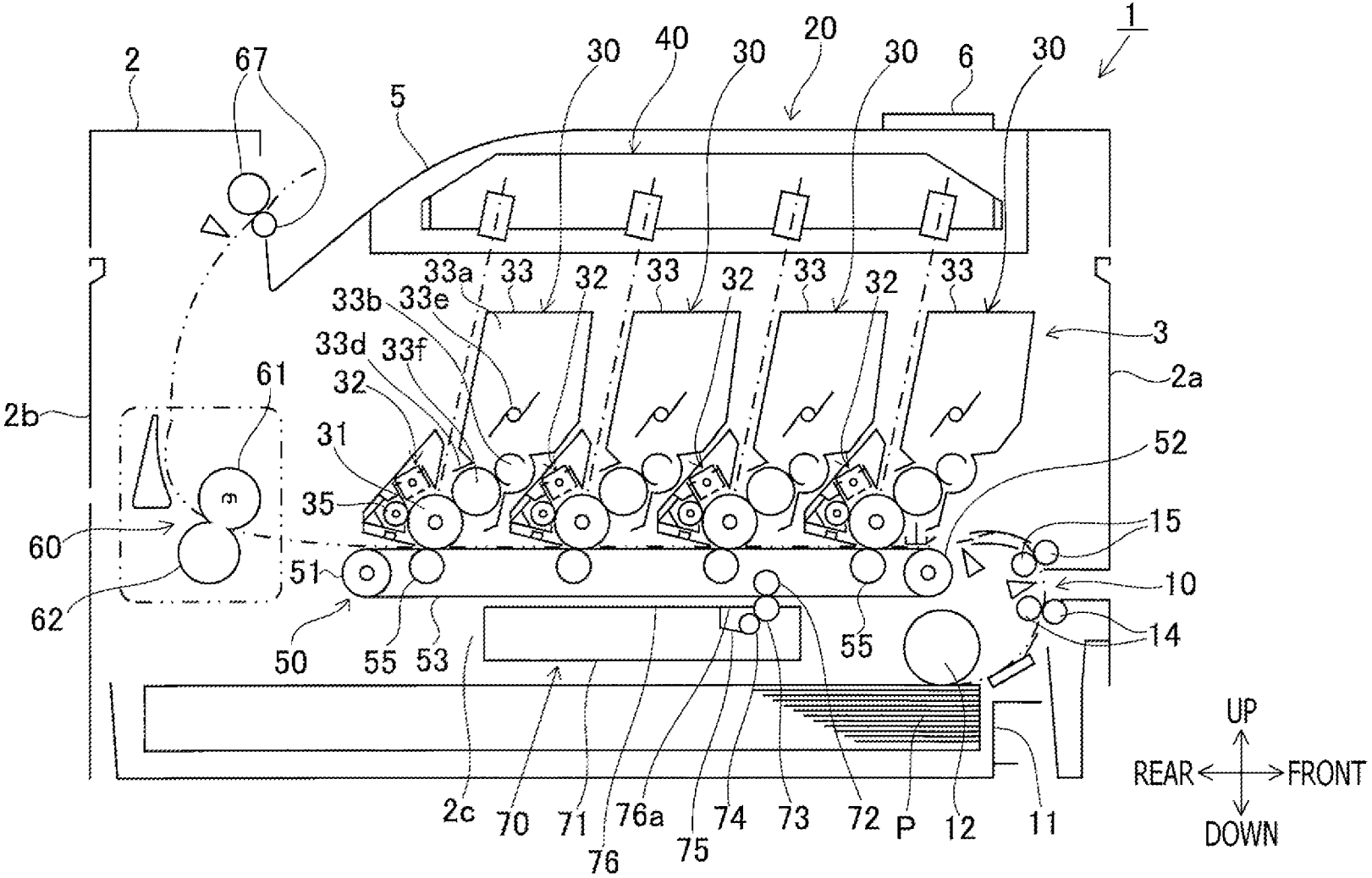
FIG. 1 schematically shows a cross-sectional side view of a laser printer according to aspects of the present disclosures.

FIG. 1 schematically shows a cross-sectional side view of a laser printer 1 according to the present disclosures. A right-hand side and a left-hand side of FIG. 1 are referred to as a front side and a rear side of the laser printer 1, respectively. Further, a closer side and a farther side with respect to a plane of FIG. 1 will be referred to as a left side and a right side of the laser printer 1, respectively. Further, an upside and a downside of FIG. 1 will be referred to as an upside and a downside of the laser printer 1, respectively.

The laser printer 1 has a sheet feeding part 10, an image forming part 20, and a housing 2 accommodating respective parts. The sheet feeding part 10 and the image forming part 20 are accommodated in the housing 2. A front cover 2*a* is openably provided to a front surface of the housing 2, and a rear cover 2*b* is openably provided to a rear surface of the housing 2. On an upper surface of the housing 2, an operation panel 6 and a sheet ejection tray 5 are provided. The operation panel 6 is configured to display, for example, printing functions, setting menus, reaming amounts or color toners, an occurrence of a sheet jam, and the like. The operation panel 6 also displays messages indicating necessity of exchanging a waste toner box 71, cleaning wire, and the like. The operation panel 6 further serves as operation buttons to select print functions, perform various settings, and the like. As the operation panel 6, an LCD panel or an organic EL panel provided with a touch sensor thereon may be used. It is noted that the operation panel 6 is an example of a notifying device.

The sheet feeding part 10 is configured to feed a sheet P to the image forming part 20. It is noted that, according to the present disclosures, the sheet P includes various types of sheets on which a toner image (a developer image) can be transferred. Such a sheet P includes a sheet made of paper and a sheet made of synthetic resin, and the like. The sheet feeding part 10 is provided with a sheet feed tray 11, a feeding roller 12, a conveying roller pair 14 and a registration roller pair 15.

The sheet feed tray 11 is detachably attached to a lower part of the housing 2. The sheet feed tray 11 is configured to accommodate a plurality of sheets Pin a stacked manner. Further, the sheet feed tray 11 can accommodate any of multiple sizes of sheets (e.g., A4 size sheets, B5 size sheets or the like) having different sizes at least in a sheet conveying direction. The feeding roller 12 is driven to rotate by a sheet feed motor (not shown) and conveys the topmost sheet P of the sheets P accommodated in the sheet feed tray 11 toward the conveying roller pair 14. The conveying roller pair 14 nips the sheet P fed by the feeding roller 12 therebetween and conveys the same toward the registration roller pair 15. The registration roller pair 15 nips the sheet P conveyed from the conveying roller pair 14 therebetween and conveys the same toward the image forming part 20. Each of the conveying roller pair 14 and the registration roller pair 15 are driving by a registration motor (not shown) to rotate.

The image forming part 20 is arranged inside the housing 2 and is provided with a drum unit 3, an exposing part 40, a transferring part 50, and a fixing part 60. The exposing part 40 is arranged at an upper portion inside the housing 2, and is provided with not-shown but well-known laser light source, polygonal mirror and the like. The drum unit 3 includes four process cartridges 30. The four process cartridges 30 have the same structure and contains cyan, magenta, yellow and black toners in this order from the frontmost process cartridge 30. The drum unit 3 can be removed by opening the front cover 2*a* to expose an opening on the front surface of the housing and withdrawing the drum unit 3 from the opening. When a jam of the sheet P occurs in the transferring part 50, a user can access a portion where the jam occurs by opening the front cover 2*a* and withdraw the drum unit 3 frontward.

Next, a configuration of the process cartridge 30 will be described. The process cartridge 30 includes a photosensitive drum 31, a charger 32 and a toner cartridge 33. The toner cartridge 33 has a toner chamber 33*a*, a toner supplying roller 33*b*, a developing roller 33*f*, a layer thickness regulating blade 33*d*, and an agitator 33*e*. The toner chamber 33*a* accommodates toner, which is a developing agent. The agitator 33*e* is configured to agitate the toner accommodated in the toner chamber 33*a*. As agitated by the agitator 33*e*, the toner is positively charged. The toner supplying roller 33*b* is configured to supply the toner in the toner chamber 33*a* to an outer circumferential surface of the developing roller 33*f*. The layer thickness regulating blade 33*d* regulates the toner supplied onto the outer circumferential surface of the developing roller 33*f* to have a particular thickness. To a roller shaft that rotatably supports the developing roller 33*f*, a positive developing voltage is applied by a developing voltage applying circuit, which is well-known and is not shown in the drawings.

The photosensitive drum 31 is arranged to face the developing roller 33*f*. The charger 32 is arranged in the vicinity of an outer circumferential surface of the photosensitive drum 31. The charger 32 is a scorotron charger having a wire and a grid electrode. When a charging voltage is applied to the wire, a potential difference is formed between the wire and the photosensitive drum 31. Then, a corona discharge occurs between the wire and the photosensitive drum 31, and the outer circumferential surface of the photosensitive drum 31 is positively charged. The exposing part 40 is configured to emit a laser beam, which is modulated in accordance with print data, onto the outer circumferential surface of the photosensitive drum 31. Then, on the outer circumferential surface of the photosensitive drum 31, a potential of a portion onto which the laser beam is incident is lowered, thereby an electrostatic latent image being formed on the outer circumferential surface of the photosensitive drum 31. That is, the outer circumferential surface of the photosensitive drum 31 is exposed to the laser beam. Then, a potential difference is generated between the developing roller 33*f* and the electrostatic latent image formed on the outer circumferential surface of the photosensitive drum 31, and the toner supplied to the developing roller 33*f* is transferred onto the latent image. The toner is then held by the electrostatic latent image, thereby the toner image (an example of a toner image) being formed and held on the outer circumferential surface of the photosensitive drum 31. That is, the electrostatic latent image is developed.

When a negative transfer current is output to the transfer roller 55 (or a negative transfer voltage is applied to the transfer roller 55), the toner image on the outer circumferential surface of the photosensitive drum 31 is transferred on a sheet P nipped between the photosensitive drum 31 and the conveying belt 53. That is, an image is printed on the sheet P. The toner supplying roller 33*b* and the developing roller 33*f* are driven to rotate by a process motor (not shown). A cleaning roller 35 is arranged to face the photosensitive drum 31. The cleaning roller 35 is configured to urge the photosensitive drum 31 and clean the outer circumferential surface of the photosensitive drum 31 in association with rotation of the photosensitive drum 31.

The transferring part 50, which is also known as a belt unit, is arranged at a higher position than the sheet feeding part 10, and at a lower position than the drum unit 3. The transferring part 50 is provided with a driving roller 51, a driven roller 52, a conveying belt 53 and four transfer rollers 55. The driving roller 51 is arranged at a lower position with respect to a rear end of the drum unit 3, and the driven roller 52 is arranged at a lower position with respect to a front end of the drum unit 3. The conveying belt 53 is an endless looped belt and looped around the driving roller 51 and the driven roller 52. The driving roller 51 is driven by a conveying motor (not shown) to rotate. As the driving roller 51 rotates, the conveying belt 53 is driven by the driving roller 51 to move, and the driven roller 52 is driven by the conveying belt 53 to rotate.

The fixing part 60 has a fixing roller 61 and a pressing roller 62 which are arranged to face each other. The sheet P conveyed from the transferring part 50 to a fixing part 60 is pressed by the fixing roller 61 and the pressing roller 62. Then, the toner image transferred on the sheet P is heat-fixed on the sheet P by the heat applied by the fixing roller 61 and by the pressure applied from the pressing roller 62. The fixing roller 61 has a built-in heater (not shown), which heats the fixing roller 61 to a particular fixing temperature. The fixing roller 61 is driven, by a fixing motor (not shown), to rotate. The sheet P passed through the fixing part 60 is ejected, by an ejection roller pair 67 arranged at an upper portion of the fixing part 60, to a sheet ejection tray 5 formed on the top surface of the housing 2. The ejection roller pair 67 is driven to rotate by an ejection motor (not shown). The sheet ejection tray 5 is configured to hold the ejected sheets P in a stacked manner.

Next, a cleaning operation will be described. The cleaning operation is to clean the conveying belt 53 by removing and collecting adhered substances such as waste toner adhered to the conveying belt 53. The waste toner includes toner supplied to the developing roller 33*f* but not transferred on the sheet P, paper powders and the like. For this purpose, the laser printer 1 is provided with a cleaning mechanism 70. The cleaning mechanism 70 includes a waste toner box 71, a backup roller 72, a cleaning roller 73, a collecting roller 74, and a removing blade 75. Each of the cleaning roller 73 and the collecting roller 74 is rotatably supported by walls, which are provided on the right and left sides of the waste toner box 71 and face each other. The cleaning roller 73 and the collecting roller 74 are configured to be detachably attached together with the waste toner box 71. Most of the adhered substances such as the toner and the paper powders adhered onto the outer circumferential surface of each photosensitive drum 31 are transported onto the conveying belt 53. Accordingly, by removing the adhered substances on the conveying belt 53, the adhered substances on the outer circumferential surface of each photosensitive drum 31 are removed by the conveying belt 53. That is, by cleaning the conveying belt 53, each photosensitive drum 31 can be cleaned. It is noted that the waste toner box 71 is an example of a container, and at least one of the cleaning roller 73, the collecting roller 74 and the removing blade 75 is an example of a collecting member.

The waste toner box 71 is configured to store the adhered substances removed from the conveying belt 53. The waste toner box 71 is made of resin and has a flat box shape when viewed from the above. The waste toner box 71 is arranged between a lower part of the conveying belt 53 and an upper part of the sheet feed tray 11. The waste toner box 71 is detachably attached to a pair of attachment parts 2*c* provided inside the housing 2. It is noted that the pair of attachment parts 2*c* could be, for example, a pair of frames, a pair of stays or a pair of assemblies, which are arranged on the right and left sides and face each other inside the housing 2. Right and left opposite sidewalls of the waste toner box 71 is configured to be detachably attached to the pair of attachment parts 2*c*. FIG. 1 shows only one of the pair of attachment parts 2*c* and the other of the pair of attachment parts 2*c* is not shown in FIG. 1. By opening the front cover 2*a* and pulling the drum unit 3 frontward, it becomes possible to draw out the transferring part 50 frontward. By drawing out the transferring part 50 frontward, the waste toner box 71 can be detached from the attachment part 2*c* and withdrawn frontward the printer 1.

Figure 2:
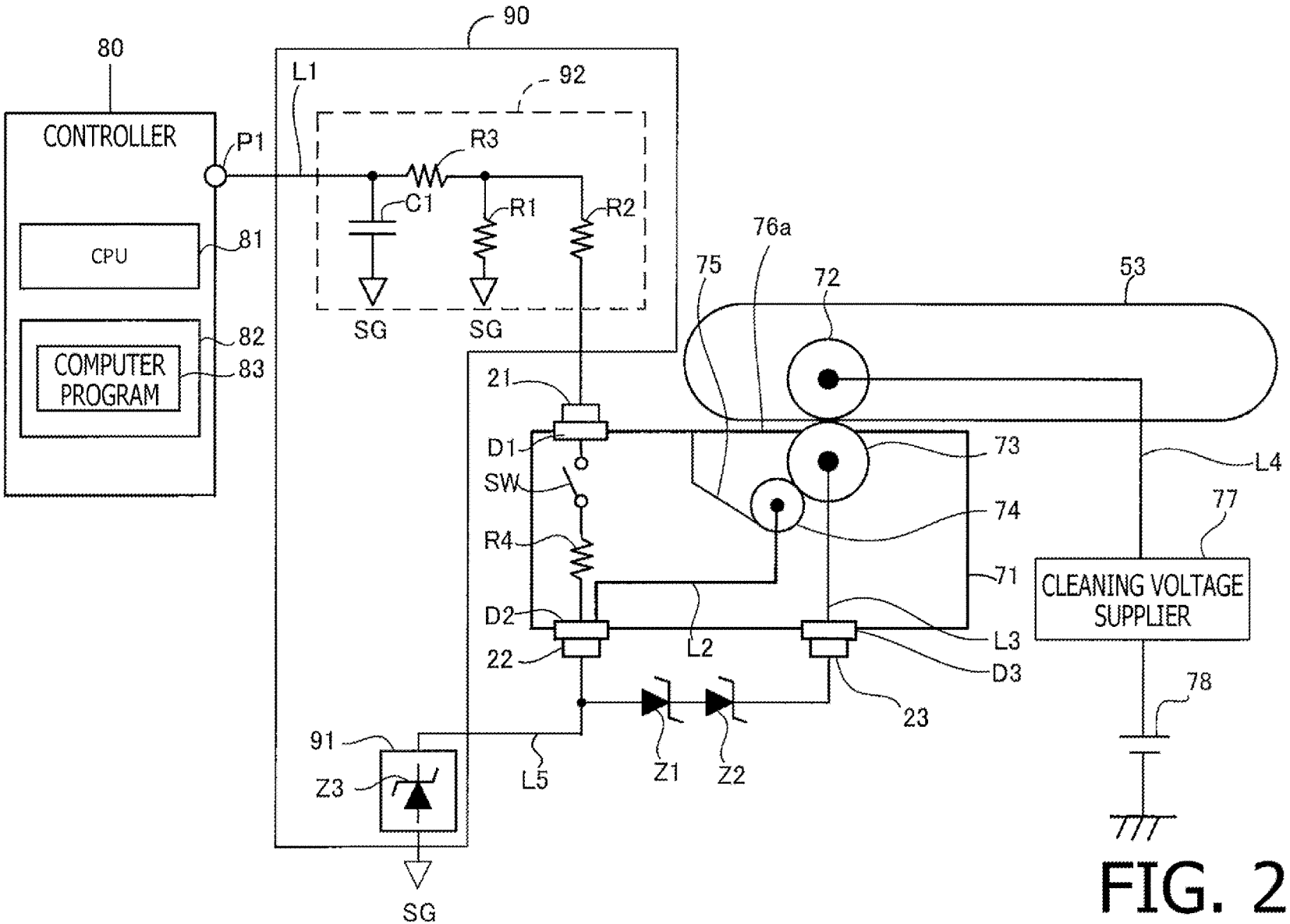
FIG. 2 is a diagram illustrating components for performing a full state detecting process according to a first embodiment of the present disclosures.

On a top plate 76 of the waste toner box 71, an opening 76*a* is formed. Further, as shown in FIG. 2, on walls of the waste toner box 71, a first electrode D1, a second electrode D2 and a third electrode D3 are provided. The first electrode D1 is electrically connectable to and disconnectable from an attachment part side first electrode 21 which is provided to the attachment parts 2*c* to which the waste toner box 71 is to be attached (see FIG. 1). The first electrode 21 is urged, by an urging member such as a coil spring (not shown), to the first electrode D1. The second electrode D2 is connectable to and disconnectable from an attachment part side second electrode 22 provided to the attachment parts 2*c*. The third electrode D3 is connectable to and disconnectable from an attachment part side third electrode 23 provided to the attachment parts 2*c*. The first electrode D1 is an example of a first contact and the second electrode D2 is an example of a second contact.

The cleaning roller 73 is a cylindrical member and rotatably arranged inside the waste toner box 71 such that a rotation shaft thereof is aligned in a width direction of the conveying belt 53. Concretely, the cleaning roller 73 is arranged at the opening 76*a* of the waste toner box 71 below the conveying belt 53, a circumferential surface thereof being exposed upward through the opening 76*a*. The circumferential surface of the cleaning roller 73 contacts an outer circumferential surface of the conveying belt 53. At the contact portion where the cleaning roller 73 and the conveying belt 53 contact, the cleaning roller 73 rotates in a direction opposite to the moving direction of the conveying belt 53 (i.e., the cleaning roller 73 rotates in a clockwise direction and the conveying belt 53 rotates in a counterclockwise direction in FIG. 1). The cleaning roller 73 has a metallic main body and an elastic layer covering an outer circumferential surface of the metallic main body. The elastic layer is formed of, for example, a forming member made of silicon.

The backup roller 72 is also a cylindrical member and arranged inside the loop of the conveying belt 53 to face the cleaning roller 73 with the conveying belt 53 therebetween. The backup roller 72 contacts an inner surface of the conveying belt 53, the cleaning roller 73 contacts an outer surface of the conveying belt 53, and the backup roller 72 and the cleaning roller 73 nip the conveying belt 53 therebetween. The backup roller 72 is arranged such that a rotation shaft thereof is aligned with the width direction of the conveying belt 53. The outer circumferential surface of the backup roller 72 contacts an inner circumferential surface of the conveying belt 53. At a portion where the backup roller 72 contacts the conveying belt 53, the backup roller 72 rotates in a direction same as the moving direction of the conveying belt 53 (i.e., both the backup roller 72 and the conveying belt 53 rotate in the counterclockwise direction in FIG. 1). The backup roller 72 is made of metal.

The collecting roller 74 is a cylindrical member and rotatably arranged inside the waste toner box 71 with an rotation shaft aligned with the width direction of the conveying belt 53. The rotation shaft of the collecting roller 74 is arranged to oppose to the rotation shaft of the cleaning roller 73. An outer circumferential surface of the collecting roller 74 contacts the outer circumferential surface of the cleaning roller 73. Inside the waste toner box 71, the collecting roller 74 is arranged such that the rotation shaft thereof is located at a lower and rearward position with respect to the position of the rotation shaft of the cleaning roller 73. It is noted that the collecting roller 74 rotates in a direction opposite to the rotation direction of the cleaning roller 73.

The cleaning roller 73 is connected to the third electrode D3 with a connection line L3. The collecting roller 74 is connected to the second electrode D2 with a connection line L2. The attachment part side second electrode 22 connected to the second electrode D2 is connected to a signal ground SG. The backup roller 72 is an example of a first roller, the cleaning roller 73 is an example of a second roller, and the collecting roller 74 is an example of a third roller.

The attachment part side second electrode 22 and the attachment part side third electrode 23 are connected with a serial connection body of two Zener diodes Z1 and Z2. Concretely, an anode of the Zener diode Z1 is connected to the second electrodes 22 and the signal ground SG. A cathode of the Zener diode Z1 is connected to an anode of the Zener diode Z2. A cathode of the Zener diode Z2 is connected to the attachment part side third electrode 23.

On the top plate 76 of the waste toner box 71, the removing blade 75, which is configured to remove the adhered substances on the outer circumferential surface of the collecting roller 74, is provided. A proximal end of the removing blade 75 is arranged on a rear side portion of the top plate 76 with respect to the collecting roller 74. A distal end of the removing blade 75 is arranged at a lower position of the collecting roller 74 and contacts the outer circumferential surface of the collecting roller 74. The removing blade 75 is formed to be a thin plate and has elasticity. The removing blade 75 is made of synthetic resin such as soft urethane. The distal end of the removing blade 75 is urged to contact the outer circumferential surface of the collecting roller 74. Accordingly, the adhered substances such as the toner and paper powders are removed by the distal end of the removing blade 75 and fall inside the waste toner box 71. The adhered substances which are fallen inside the waste toner box 71 are gradually accumulated from a front side toward a rear side inside the waste toner box 71.

By a connection line L4, a collecting voltage supplier 77 is connected to the backup roller 72. The collecting voltage supplier 77 is a circuit configured to generate a collecting voltage BCLN to be supplied to the backup roller 72. The collecting voltage supplier 77 is connected between the backup roller 72 and a plus terminal of a power source 78. According to the present embodiment, the collecting voltage supplier 77 is a boosting circuit including a switching element and a controller configured to control a duty ratio of the switching element. The collecting voltage supplier 77 boosts a positive voltage (24 V) supplied from the power source 78 to supply the positive collecting voltage BCLN to the backup roller 72. Further, the collecting voltage supplier 77 performs a constant current control to adjust the collecting voltage BCLN in order to control a cleaning current flowing through the rollers 72, 73 and 74. According to the present embodiment, the collecting voltage supplier 77 detects an electrical current flowing through the collecting roller 74 as a detection current, and adjusts the collecting voltage BCLN to become close to a command current.

When the collecting voltage supplier 77 applies the collecting voltage BCLN to the backup roller 72, the cleaning current flows through each of the backup roller 72, the cleaning roller 73 and the collecting roller 74, and an attracting voltage is generated in each of the rollers 72, 73 and 74. According to the present embodiment, the attracting voltages generated in the backup roller 72, the cleaning roller 73 and the collecting roller 74 decrease in this order. Therefore, the adhered substances such as toner and the paper powders adhered to the outer circumferential surface of the conveying belt 53 are electrically attracted by the cleaning roller 73. The adhered substances adhered to the cleaning roller 73 are then electrically attracted by the collecting roller 74. The adhered substances adhered to the collecting roller 74 are removed by the removing blade 75 and accommodated in the waste toner box 71.

Next, a configuration related to the full state detecting process will be described. The full state detecting process is a process for detecting whether the waste toner box 71 becomes full of the adhered substances accommodated therein.

As shown in FIG. 2, the laser printer 1 has a detection switch SW, a substrate 90 and a controller 80. The detection switch SW is configured such that, when the waste toner box 71 has become full of the adhered substances, the state of the detection switch SW is changed from a closed state to an opened state. According to the present embodiment, the detection switch SW is arranged inside the waste toner box 71. A first end of the detection switch SW is connected to the first electrode D1 and a second end of the detection switch SW is connected, via an electrical resistor R4, to the second electrode D2. The detection switch SW has a pair of switch electrodes and a switch cam configured to change its attitude between an urging attitude to set the contacts of the pair of switch electrodes in a closed state and an opening attitude to set the contacts of the pair of switch electrodes in an opened state. When the waste toner box 71 is not full of the adhered substances, the switch cam maintains the urging attitude, and the contacts of the pair of switch electrode keep the closed state (i.e., the detection switch SW is in a closed state). When the waste toner box 71 has become full of the adhered substances, the switch cam has changed it attitude to the opened attitude, and the state of the contacts of the pair of switch electrodes changed from the closed state to the opened state (i.e., the detection switch SW is in an opened state).

The substrate 90 is provided with a circuit configured to generate a voltage to be supplied to electrical loads, which the sheet feeding part 10 and the image forming part 20 have. Further, the substrate 90 has a high voltage generator 91 and a detection signal generator 92, which are parts related to the full state detecting process. It is noted that the substrate 90 may be provided with the above-described collecting voltage supplier 77.

The high voltage generator 91 is configured to generate a high voltage Vh to be applied to the second end side of the detection switch SW. According to the present embodiment, the high voltage generator 91 has a Zener diode Z3. A cathode of the Zener diode Z3 is connected, through the second electrode D2 and the attachment part side second electrode 22, to the connection line L2 which is connected to the collecting roller 74. An anode of the Zener diode Z3 is connected to the signal ground SG. The Zener diode Z3 is serially connected, on a connection line L5 which connects the attachment part side second electrode 22 and the signal ground SG, between a connecting point of the anode of the Zener diode Z1 and the signal ground SG.

When the collecting voltage BCLN is applied to the backup roller 72, an electrical current flows through the Zener diode Z3 due to the attracting voltage of the collecting roller 74, and the high voltage generator 91 generates the high voltage Vh. According to the present embodiment, the connection line L2 and the high voltage generator 91 are examples of an attracting voltage supplying circuit. The high voltage generator 91 is an example of a reference voltage generating circuit configured to generate a reference voltage. It is noted that the high voltage generator 91 may be provided with a resistor instead of the Zener diode, or both the Zener diode Z3 and a resistor.

The detection signal generator 92 is connected to the attachment part side first electrode 21, and generates the detection signal FB using the high voltage Vh generated at the first electrode D1 and the attachment part side first electrode 21. The detection signal generator 92 has a first resistor R1, a second resistor R2, a third resistor R3 and a condenser C1. One end of the second resistor R2 is connected to the attachment part side first electrode 21. The other end of the second resistor R2 is connected to one end of the first resistor R1, and the first resistor R1 and the second resistor R2 constitute a serial connection body. A resistance value of the second resistor R2 is much larger than a resistance value of the first resistor R1. One end of the third resistor R3 is connected to a connection point of the first resistor R1 and the second resistor R2, and the other end of the third resistor R3 is connected to the connection line L1. One end of the condenser C1 is connected to the connection line L1, and the other end of the condenser C1 is connected to the signal ground SG.

According to the above configuration, the high voltage at the attachment part side first electrode 21 is divided at a dividing ratio of (R1/(R1+R2)) and output, as the detection signal FB, from the other end of the third resistor R3. In this case, since the resistance value of the second resistor R2 is much larger than the resistance value of the first resistor R1, the detection signal FB is smaller than the high voltage Vh at the attachment part side first electrode 21.

The controller 80 includes a CPU 81 and a storage 82. The storage 82 stores a computer program 83 which, when executed by the CPU 81, causes the controller 80 to perform the full state detecting process. An input port P1 of the controller 80 is connected to the connection line L1 which is connected to the third resistor R3 of the detection signal generator 92.

When the waste toner box 71 is not full of the adhered substances, the detection switch SW is in the opened state. In this case, the detection signal FB, which is a divided voltage by dividing the high voltage Vh generated by the high voltage generator 91 at the dividing ratio, is generated at the input port P1. When the waste toner box 71 has become full of the adhered substances, the state of the detection switch SW is changed from the closed state to the opened state. In this case, the high voltage Vh is not generated at the first electrode D1 and the attachment part side first electrode 21, and the voltage at the input port P1 of the controller 80 decreases close to 0V. Therefore, based on the voltage at the input port P1, the controller 80 can determine whether the waste toner box 71 is full of adhered substances or not.

When the detection signal FB increases and reached to the voltage indicating that the waste toner box 71 is full of the adhered substances, the controller 80 notifies that the waste toner box 71 is full of the adhered substances, for example, by displaying a message notifying "the container is full" on the operation panel 6.

When the detection switch SW is in the opened state, the high voltage Vh generated by the high voltage generator 91 decreases through the signal ground SG connected to the connection line L5. According to the present embodiment, the Zener diode Z3 and the connection line L4 is an example of a bypass circuit.

Full State Detecting Process

Figure 3:
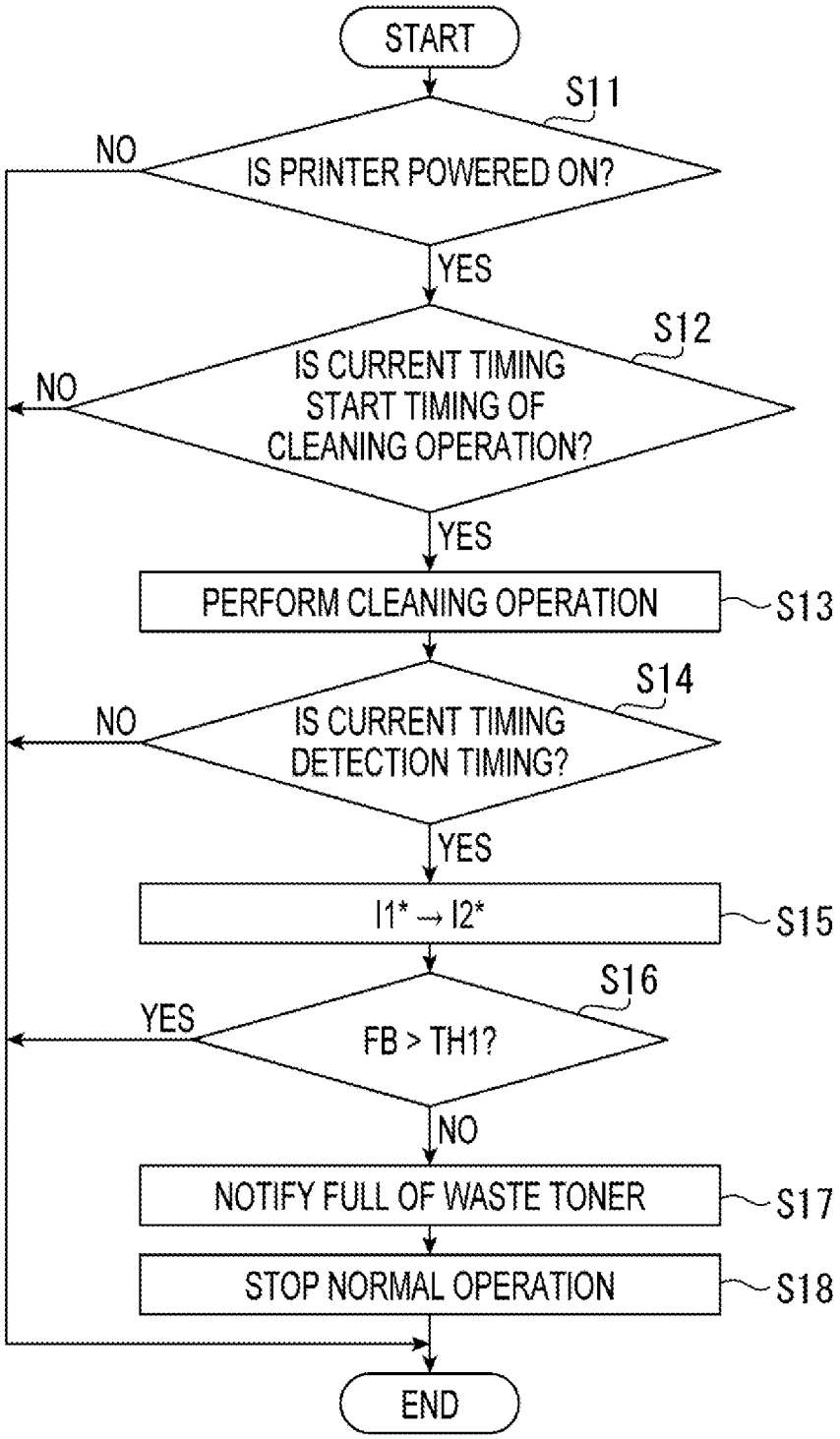
FIG. 3 is a flowchart illustrating a cleaning operation and the full state detecting process.

Next, referring to FIG. 3, the full state detecting process executed by the controller 80 will be described. The process shown in FIG. 3 is repeatedly performed by the controller 80.

In S11, the controller 80 determines whether the laser printer 1 is powered on. When determining that the laser printer 1 is not powered on (S11: NO), the controller 80 terminates the process shown in FIG. 3. When determining the laser printer 1 is powered on (S11: YES), the controller 80 determines whether a current timing is a start timing of the cleaning operation in S12. When determining that the current timing is not the start timing of the cleaning operation (S12: NO), the controller 80 terminates the process shown in FIG. 3.

When determining that the current timing is the start timing of the cleaning operation (S12: YES), the controller 80 performs the cleaning operation in S13. Concretely, the controller 80 controls the collecting voltage supplier 77 to apply the collecting voltage BCLN to the backup roller 72. According to the present embodiment, the controller 80 sets a command current Ic* for causing the collecting voltage supplier 77 to perform a constant current control to a command value I1*. Then, the adhered substances adhered to the conveying belt 53 are electrically attracted by the cleaning roller 73. The adhered substances adhered to the cleaning roller 73 are then electrically attracted by the collecting roller 74. The adhered substances adhered to the collecting roller 74 is removed by the removing blade 75 and collected in the waste toner box 71.

In S14, the controller 80 determines whether a current timing is an execution timing of the full state detecting process (i.e., a timing to detect a voltage change at the input port P1). According to the present embodiment, a timing within a particular determination period Td after completion of the cleaning operation is defined as the execution timing of the full state detecting process. It is because the adhered substances in the waste toner box 71 significantly increase as the cleaning operation has been performed. When determining that the current timing is not the timing to detect the voltage change at the input port P1 (S14: NO), the controller 80 terminates the process shown in FIG. 3. In this case, the controller 80 performs an ordinary operation (e.g., printing). It is noted that the particular determination period Td may be set before the cleaning operation.

When determining that the current timing is the timing to detect the voltage change at the input port P1 (S14: YES), the controller 80 changes a value of the command current Ic* to be sent to the collecting voltage supplier 77 from the command value I1* to a determination command value I2* which is greater than the command value I1*. Then, the collecting voltage supplier 77 adjusts the collecting voltage BCLN to be supplied to the backup roller 72 such that the cleaning current flowing through the collecting roller 74 becomes the determination command value I2*.

In S16, the controller 80 determines whether the detection signal FB received through the input port P1 is higher than a threshold value TH1. The threshold value TH1 is determined based on the detection signal FB generated by the detection signal generator 92 when the detection switch SW is in the opened state. The threshold value TH1 is, for example, 0V. When the detection signal FB is higher than the threshold value TH1 (S16: YES), the waste toner box 71 is not full of the adhered substances, and the controller 80 terminates the process shown in FIG. 3. When determining that the detection signal FB is equal to or less than the threshold value TH1 (S16: NO), the controller 80 proceeds to S17.

In S17, the controller 80 notifies that the waste toner box 71 is full of the adhered substances. The notification is done by, for example, outputting a full-state notification signal indicating that the waste toner box 71 is full of the adhered substances to the operation panel 6 to cause the operation panel 6 to display a message notifying that "the container is full." In S18, the controller 80 controls the laser printer 1 to stop its normal operation. That is, the controller 80 stops the normal operation of the laser printer 1 and notifies that the waste toner box 71 is full to prompt the user to exchange the waste toner box 71. It is noted that the controller 80 may notify the full state of the waste toner box 71 to an external terminal device such as a computer or a mobile terminal controlling the laser printer 1. After execution of S18, the controller 80 terminates the process shown in FIG. 3.

It is noted that S13 is an example of a cleaning operation executing part, and S16 is an example of a determining part.

Figure 4A:
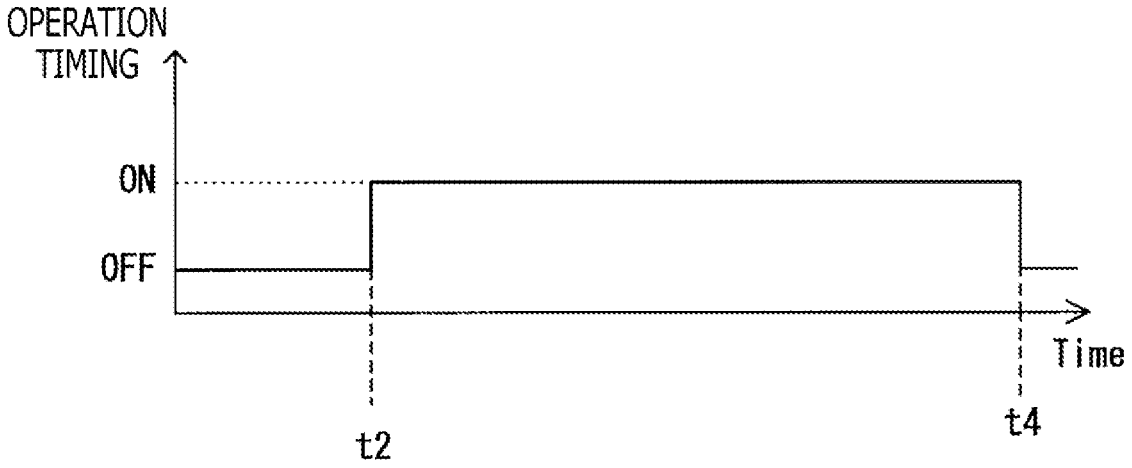
FIGS. 4A, 4B and 4C show a timing chart of the cleaning operation and the full state detecting process.
Figure 4B:
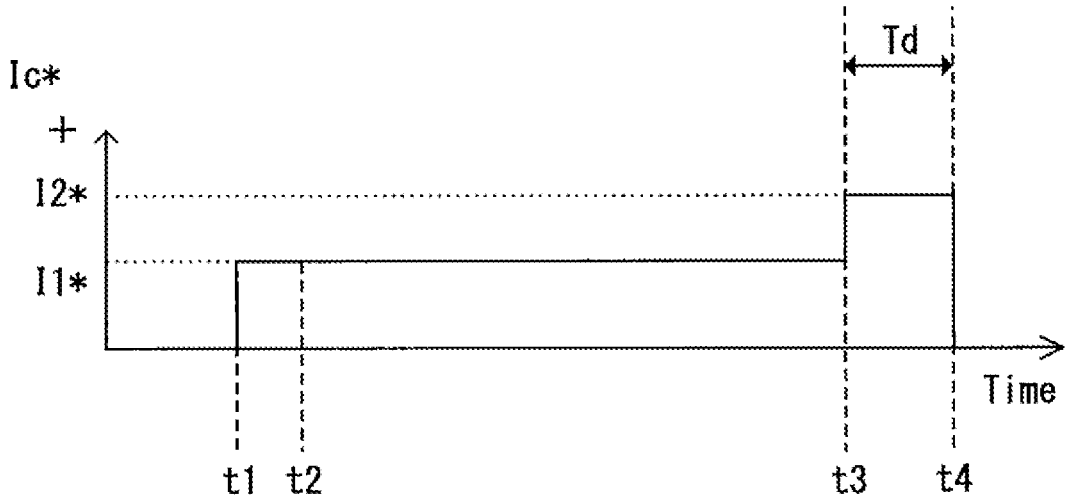
Figure 4C:
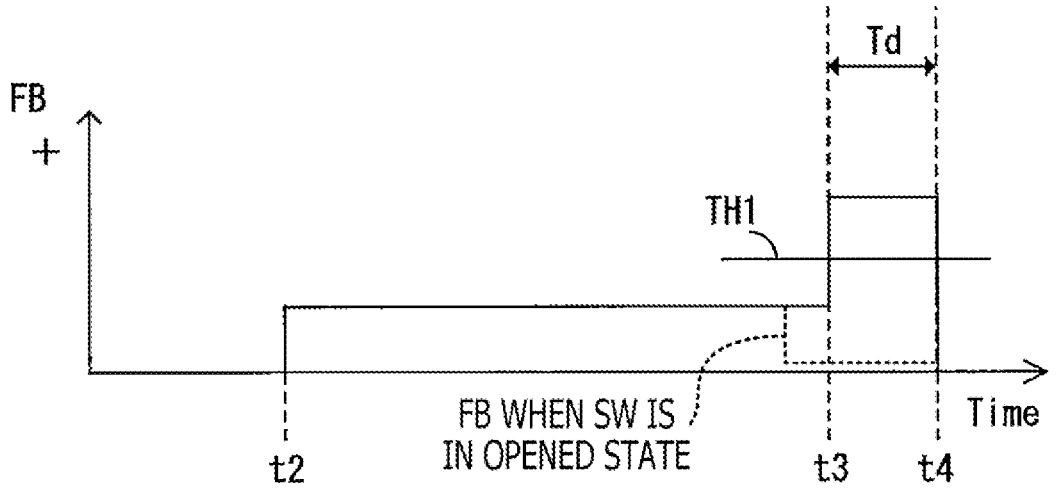

Next, referring to FIGS. 4A-4C, the start timings of the full state detecting process will be described. FIG. 4A is a timing chart illustrating a drive timing of the backup roller 72. FIG. 4B is a timing chart showing the transition of the command current Ic* of the collecting volage supplier 77. FIG. 4C is a timing chart showing the transition of the detection signal FB.

Time t1 is the start timing of the cleaning operation. As shown in FIG. 4B, the command current Ic* is set to the command value I1* at time t1. Then, at time t2, the backup roller 72, the cleaning roller 73 and the collecting roller 74 are started to rotate, thereby the cleaning operation being started. Thereafter, at time t3, the cleaning operation is terminated.

Since the determination period Td for performing the full state detecting process starts after time t3 when the cleaning operation is stopped, the command current Ic* is changed from the command value I1* to the command value I2* at time t3 (see FIG. 4B). In FIG. 4C, the detection signal FB indicated by solid lines represents the detection signal FB when the detection switch SW is kept in the closed state (i.e., when the full state of the waste toner box 71 has not yet been detected). The detection signal FB during the determination period Td has a higher voltage than the detection signal FB during the cleaning operation. Since the detection signal FB indicated by the solid line is greater than the threshold value TH1 during the determination period Td, the full state of the waste toner box 71 is not notified.

When the state of the detection switch SW becomes the full state as the waste toner box 71 becomes full, the detection signal FB becomes approximately zero (indicated by broken lines in FIG. 4C). In this case, since the detection signal FB is equal to or less than the threshold value TH1, the controller 80 notifies that the waste toner box 71 has become full. At time t4, which is after the full state of the waste toner box 71, the command current Ic* decreases as the time t4 is a termination timing of the full state detecting process.

According to the above-described embodiment, the waste toner box 71 is connected, via the first electrode D1, to the attachment part side first electrode 21. The detection switch SW is connected to the first electrode D1 at the first end thereof. When amount of the adhered substances in the waste toner box 71 becomes larger than a particular amount, the state of the detection switch SW changes from the closed state to the opened state. The collecting roller 74 is connected to the second electrode D2 through the connection line L2, and the high voltage Vh based on the attracting voltage is applied to the second end of the detection switch SW. The controller 80 determines that the waste toner box 71 is full of the adheres substances when the detection signal FB generated by the detection signal generator 92 is equal to or less than the threshold value TH1.

According to the above configuration, even though there is rust on between the first electrode D1 of the waste toner box 71 and the attachment part side first electrode 21, the high voltage Vh corresponding to the attracting voltage is applied between the first electrode D1 of the waste toner box 71 and the attachment part side first electrode 21 when the detection switch SW is in the closed state, and contact defect between the first electrode D1 of the waste toner box 71 and the attachment part side first electrode 21 can be suppressed.

The collecting voltage supplier 77 performs the constant current control to control the cleaning current flowing through the rollers 72, 73 and 74 by adjusting the collecting voltage BCLN. The high voltage generator 91 is serially connected to the second end of the detection switch SW and generates the high voltage Vh corresponding to the attracting voltage at the first end of the detection switch when the detection switch is in the closed state. According to the above configuration, a constant-current controlled stable high voltage Vh can be supplied to the first electrode D1 connected to the second end of the detection switch SW. Therefore, the contact defect between the first electrode D1 of the waste toner box 71 and the attachment part side first electrode 21 can be suppressed further.

When the detection switch SW is in the opened state, the high voltage Vh generated by the high voltage generator 91 is applied to the signal ground SG. Accordingly, even when the detection switch SW becomes in the opened state, it is avoided that the high voltage Vh is applied to other circuits on the substrate 90, and stable operations of the circuits on the substrate 90 are ensured.

The collecting voltage supplier 77 performs the constant-current control such that the cleaning current flowing through the rollers 72, 73 and 74 is controlled to be the command value I1* during the cleaning operation, and the cleaning current flowing through the rollers 72, 73 and 74 is controlled to be the command value I2* which is greater than the command value I1* during the determination period Td after the cleaning operation (or before the cleaning operation). According to the above configuration, the detection signal FB when the detection switch SW is in the closed state and the detection signal FB when the detection switch SW is in the opened state are significantly different from each other during the full state detecting process, a false detection of the state of the waste toner can be further suppressed.

Modification of First Embodiment

The above-described first embodiment may be modified such that the attracting voltage of the backup roller 72 may be applied to the second end of the detection switch SW. In such a case, the backup roller 72 and the second electrode D2 may be connected with the connection line L2.

Second Embodiment

In the following description of a second embodiment, different configurations with respect to the first embodiment will be described mainly. In the description of the second embodiment, parts/elements which are the same as those of the first embodiment will be assigned with the same reference numbers, and detailed description thereof will be omitted.

Figure 5:
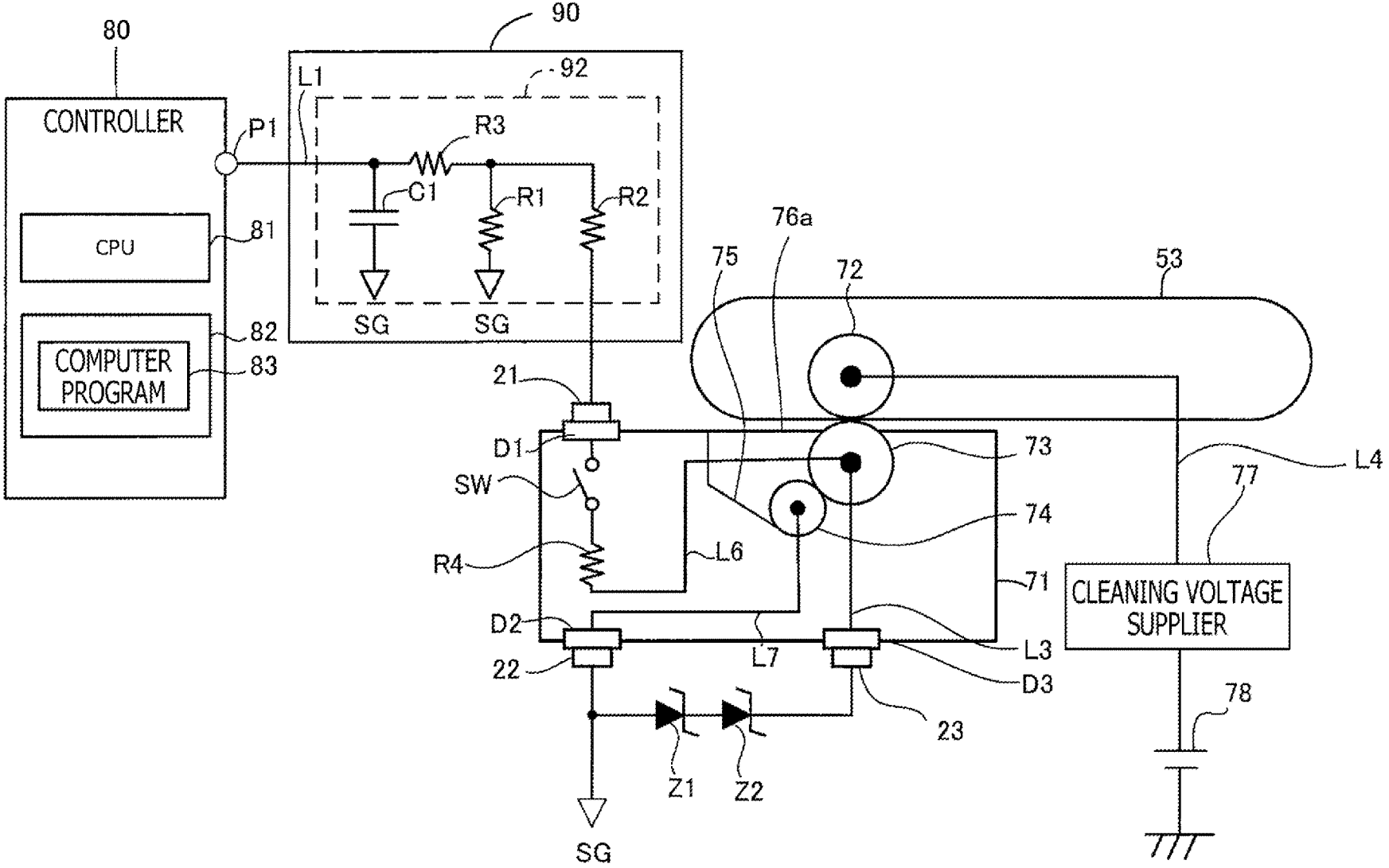
FIG. 5 is a diagram illustrating components for performing a full state detecting process according to a second embodiment of the present disclosures.

According to the second embodiment, the attracting voltage of the cleaning roller 73 is applied to the second end of the detection switch SW. According to the second embodiment, a roller serving as the supplying source of the attracting voltage is different compared to the first embodiment. As shown in FIG. 5, the electrical resistor R4 is connected to a rotation shaft of the cleaning roller 73 through the connection line L6, and the attracting voltage of the cleaning roller 73 is supplied to the second end of the detection switch SW via the electrical resistor R4. The second electrode D2 is connected to the collecting roller 74 through the connection line L7. According to the second embodiment, the connection line L6 is an example of an attracting voltage supplying part.

When the collecting voltage BCLN is being supplied to the backup roller 72, the attracting voltage of the cleaning roller 73 is supplied to the second end of the detection switch SW through the connection line L6. When the waste toner box 71 is not full of the adhered substances, and when the detection switch SW is in the closed state, the attracting voltage is supplied to the first electrode D1 and the attachment part side first electrode 21. Accordingly, the detection signal generator 92 generates the detection signal FB using the attracting voltage supplied to the attachment part side first electrode 21.

According to the above-described second embodiment, it is unnecessary to provide a new circuit for generating a voltage at the second end of the detection switch SW. Therefore, according to the second embodiment, the upsizing of the substrate 90 can be suppressed.

Third Embodiment

In the following description of a third embodiment, different configurations with respect to the first embodiment will be described mainly. In the description of the third embodiment, parts/elements which are the same as those of the first embodiment will be assigned with the same reference numbers, and detailed description thereof will be omitted.

Figure 6:
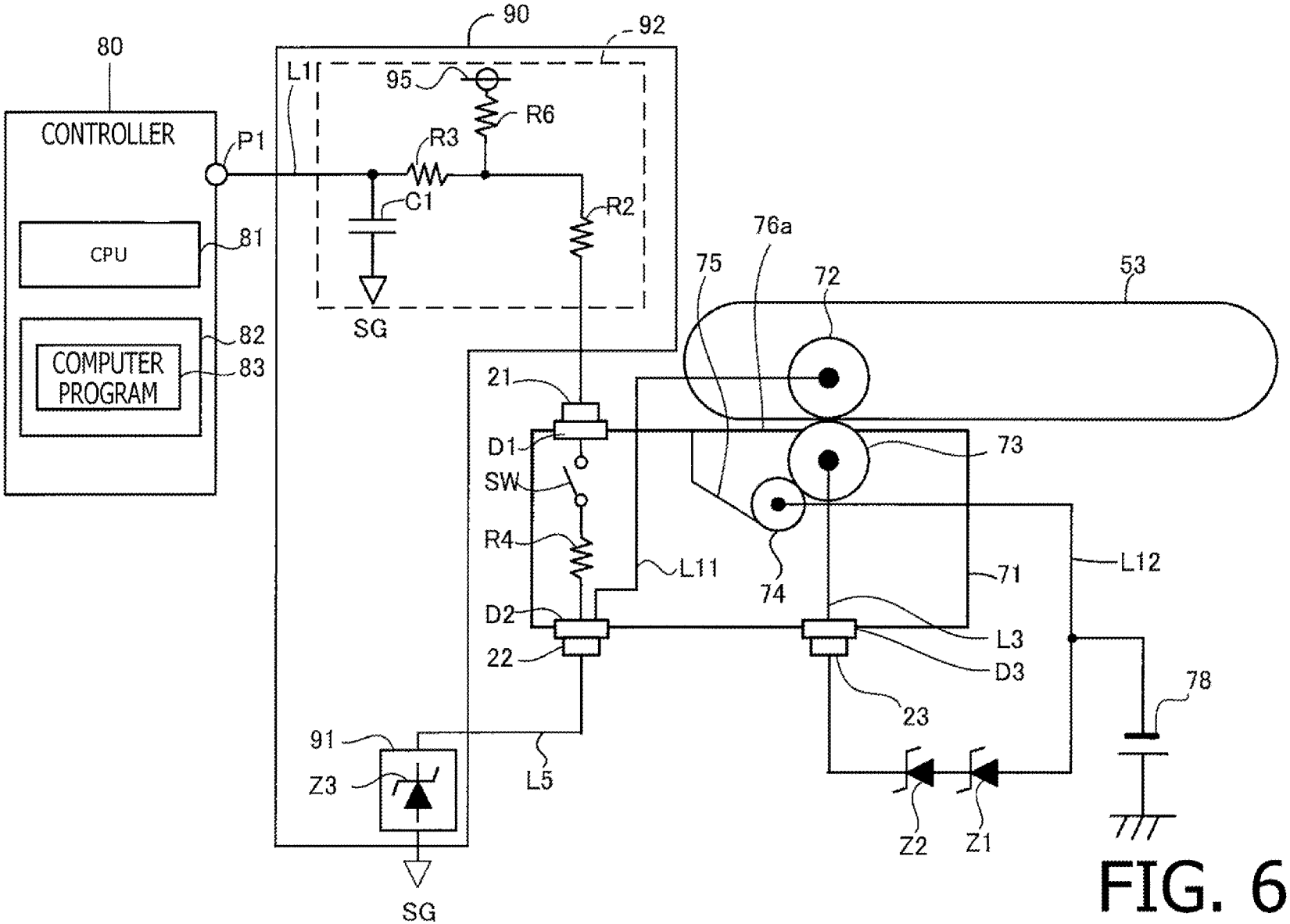
FIG. 6 is a diagram illustrating components for performing a full state detecting process according to a third embodiment of the present disclosures.

According to the third embodiment, a polarity of the voltage generated at the backup roller 72, the cleaning roller 73 and the collecting roller 74 is different from that of the first embodiment. As shown in FIG. 6, the second electrode D2 connected to the second end of the detection switch SW is connected to the backup roller 72 through a connection line L11. The attachment part side second electrode 22 is connected to the signal ground SG. A minus terminal of the power source 78 is connected with the collecting roller 74 through the connection line L12. A plus terminal of the power source 78 is grounded. The attachment part side third electrode 23 is connected to the minus terminal of the power source 78 through the Zener diodes Z1 and Z2. The Zener diodes Z1 and Z2 are connected in the forward direction, and an Anode of the Zener diode Z1 is connected to the minus terminal of the power source 78, and a cathode of the Zener diode Z2 is connected to the attachment part side third electrode 23. According to the above configuration, as the collecting voltage BCLN is supplied from the power source 78, the electric potential decreases in the order or the collecting roller 74, the cleaning roller 73 and the backup roller 72.

In the detection signal generator 92, a sixth resistor R6 is serially connected to the second resistor R2 to form a serial connection body. An end of the sixth resistor R6, which end is opposite to the end connected to the second resistor R2, is connected with a direct current voltage source 95. At a connection point where the sixth resistor R6 and the second resistor R2 are connected, a third resistor R3 is connected. An absolute value of a voltage supplied by the direct current voltage source 95 is very smaller than an absolute value of the attracting voltage of the backup roller 72.

According to the above configuration of the third embodiment, when the detection switch SW is in the closed state as the waste toner box 71 is not full of the adhered substances, a voltage corresponding to a difference between the voltage supplied by the direct current voltage source 95 and the attracting voltage of the backup roller 72 is applied to the attachment part side first electrode 21. Therefore, the detection signal FB has a divided value by dividing the voltage corresponding to the above difference in accordance with the dividing ratio of the detection signal generator 92. On the other hand, when the detection switch SW is in the opened state as the waste toner box 71 is full of the adhered substances, the detection signal FB has a value of the voltage supplied by the direct current voltage source 95. According to the above configuration, the controller 80 can determine whether the waste toner box 71 is full of the adhered substances based on the value of the detection signal FB generated at the input port P1.

Accordingly, the third embodiment described above is capable of achieving the same effects as achieved by the first embodiment.

Fourth Embodiment

In the following description of a fourth embodiment, different configurations with respect to the third embodiment will be described mainly. In the description of the fourth embodiment, parts/elements which are the same as those of the third embodiment will be assigned with the same reference numbers, and detailed description thereof will be omitted.

Figure 7:
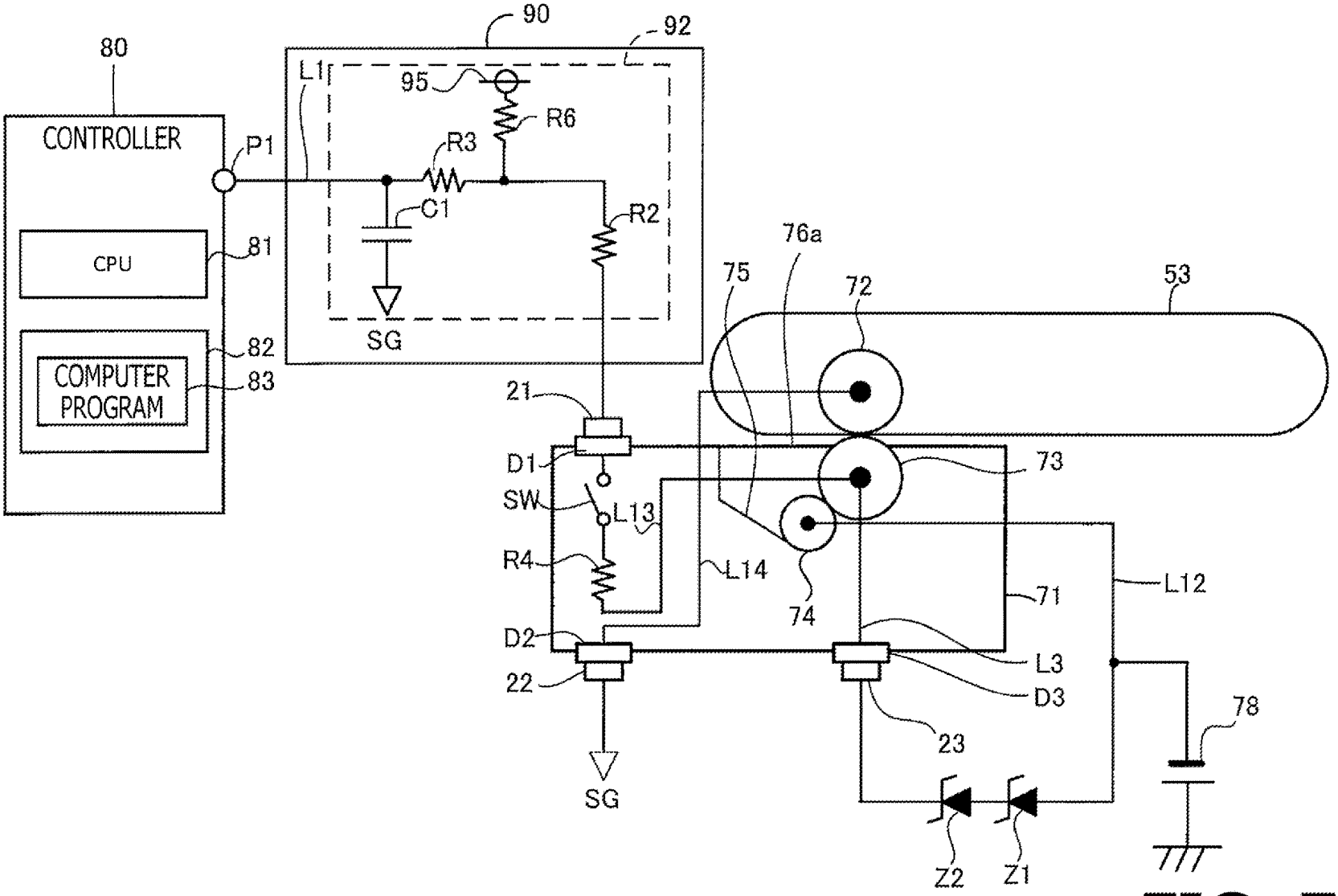
FIG. 7 is a diagram illustrating components for performing a full state detecting process according to a fourth embodiment of the present disclosures.

Differently from the third embodiment, according to the fourth embodiment, a high voltage is generated on the second end of the detection switch SW by the attracting voltage supplied from the cleaning roller 73. As shown in FIG. 7, the electrical resistor R4 connected to the second end of the detection switch SW is connected to the rotation shaft of the cleaning roller 73, thereby the attracting voltage being supplied from the cleaning roller 73. The second electrode D2 is connected to the backup roller 72 through the connection line L14.

According to the above configuration of the fourth embodiment, when the detection switch SW is in the closed state as the waste toner box 71 is not full, the detection signal FB has a value obtained by dividing the voltage, which corresponds to the difference between the voltage supplied from the direct current voltage source 95 and the attracting voltage of the cleaning roller 73, in accordance with the dividing ratio of the detection signal generator 92. On the other hand, when the detection switch SW is in the opened state as the waste toner box 71 is full of the adheres substances, the detection signal FB has a value of the voltage supplied from the direct current voltage source 95. Accordingly, the controller 80 is capable of determining whether the waste toner box 71 is full of the adhered substances based on the value of the FB signal generated at the input port P1.

Accordingly, the fourth embodiment described above is capable of achieving the same effects as achieved by the first embodiment.

Further Modifications

It is noted that various modifications of the above-described embodiments can be made within aspects of the present disclosures.

The controller 80 may be configured to perform the full state detecting process before the start timing of the cleaning process.

The controller 80 may be configured to determine that the amount of the adhered substances in the waste toner box 71 is larger than a particular amount when the absolute value of the detection signal FB is equal to or less than a particular threshold value during the determination period.

The controller 80 may have a function of the detection signal generator. In such a case, it is only necessary that the input port P1 and the attachment part side first electrode 21 are connected. It is further noted that the determining part may be realized by a part other than the controller 80.

The image forming apparatus does not need to be limited to the laser printer, but can be an MFP having functions of the laser printer, a scanner, a facsimile device and the like.

According to the above described embodiments, the toner image on the outer circumferential surface of the photosensitive drum 31 is transferred on a sheet P nipped between the photosensitive drum 31 and the conveying belt 53. However, the image forming apparatus does not need to be limited to this configuration. For example, the image forming apparatus according to the present disclosures may employ an intermediate transfer method. Specifically, the transferring part 50 may include an intermediate transfer belt, the toner image on the outer circumferential surface of the photosensitive drum 31 may be transferred on the intermediate transfer belt, and the toner image on the intermediate transfer belt may be transferred on the sheet P conveyed by the conveying belt 53. In that case, at least one of the intermediate transfer belt and the conveying belt 53 is an example of a belt.

What is claimed is:

1. An image forming apparatus, comprising:

a transferring part having a belt, the transferring part configured to transfer a toner image formed on a photosensitive member onto a sheet;

a collecting member configured to collect waste toner from the belt;

a collecting voltage supplier configured to supply a collecting voltage causing the collecting member to generate an attracting voltage to collect the waste toner from the belt;

a container having a first contact and configured to contain the waste toner collected by the collecting member;

an attachment part having a second contact configured to contact the first contact, the attachment part being configured such that the container is detachably attached to the attachment part;

a switch configured such that a switching state is switchable between a closed state and an opened state, a first end of the switch being connected to the first contact, the switching state being changed from the closed state to the opened state when an amount of the waste toner in the container is greater than a particular amount;

an attracting voltage supplying circuit configured to supply the attracting voltage to a second end from the collecting member, the second end being an opposite end to the first end of the switch;

a detection signal generator connected to the second contact and is configured to generate a detection signal based on a voltage at the second contact; and a determination part configured to determine whether or not an amount of the waste toner in the container is greater than the particular amount based on the detection signal.

2. The image forming apparatus according to claim 1, wherein the attracting voltage supplying circuit is configured to supply voltage to the first end of the switch when the switch is in the closed state.

3. The image forming apparatus according to claim 1, wherein the attracting voltage supplying circuit comprises a reference voltage generating circuit connected to the second end of the switch and configured to generate a reference voltage based on the attracting voltage.

4. The image forming apparatus according to claim 3, wherein the reference voltage generating circuit includes a Zener diode.

5. The image forming apparatus according to claim 1, wherein the collecting member comprises:

a first roller contacting an inner surface of the belt; and a second roller contacting an outer surface of the belt, the second roller being configured to nip the belt between the first roller, and wherein the attracting voltage supplying circuit includes a connection line electrically connecting the second roller and the second end of the switch.

6. The image forming apparatus according to claim 5, wherein the collecting member further comprises a third roller contacting the second roller.

7. The image forming apparatus according to claim 1, further comprising a bypass part configured to apply the attracting voltage supplied by the attracting voltage supplying circuit to a ground when the switch is in the opened state.

8. The image forming apparatus according to claim 1, further comprising a cleaning operation executing part configured to cause the collecting member to perform a cleaning operation to collect the waste toner from the belt, wherein the collecting voltage supplier is configured to:

perform a constant current control so that an electrical current flowing through the collecting member is a first current value during the cleaning operation; and perform a constant current control so that an absolute value of an electrical current flowing through the collecting member is a second current value greater than the first current value during a determination period after or before the cleaning operation.

* * * * *